US007856704B2

(12) United States Patent
Wang et al.

(10) Patent No.: US 7,856,704 B2
(45) Date of Patent: Dec. 28, 2010

(54) MONITORING SYSTEM FOR CLINCHING PROCESS

(75) Inventors: Pei-Chung Wang, Troy, MI (US); James W. Wells, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 1288 days.

(21) Appl. No.: 11/250,213

(22) Filed: Oct. 14, 2005

(65) Prior Publication Data

US 2007/0084045 A1 Apr. 19, 2007

(51) Int. Cl.
*B23P 21/00* (2006.01)

(52) U.S. Cl. ..... 29/715

(58) Field of Classification Search ..... 29/407.09, 29/407.01, 407.04, 407.05, 407.08, 407.1, 29/428, 505, 432, 432.1, 432.2, 34 R, 700, 29/705, 709, 715, 716, 717
See application file for complete search history.

(56) References Cited

U.S. PATENT DOCUMENTS 4,864,776 A * 9/1989 Morrison ..... 451/347
6,067,696 A * 5/2000 Cecil et al. ..... 29/407.01

* cited by examiner

*Primary Examiner*—John C Hong

(57) ABSTRACT

A monitoring device monitors an apparatus that clinches together sheet metal panels. In particular, a die assembly positioned on one side of the panels has a button forming die cavity defined by an anvil at the bottom of the die cavity and a plurality of radially moveably die blades at the side of the cavity. A plunger is positioned on the other side of the panels and registers with the die assembly so that linear displacement of the plunger plastically deforms the panels axially into the die assembly to engage with the anvil and then further linear displacement of the plunger will then deform the panels radially outward as permitted by the outward radial movement of the moveable die blades. Transducers measure the linear displacement of the plunger, the radial outward displacement of the radially moveable die blades, and the magnitude of the axial force applied against the anvil.

18 Claims, 2 Drawing Sheets

MONITORING SYSTEM FOR CLINCHING PROCESS

FIELD OF THE INVENTION

The present invention relates to apparatus for clinching together a stack of sheet metal panels.

BACKGROUND OF THE INVENTION

It is a known technique to attach sheet metal panels together by use of a punch that indents the stacked panels into a die assembly to form a button that mechanically interlocks the panels. The die assembly includes a button-forming cavity having an anvil at the bottom thereof and plurality of die blades forming the side of the cavity. The blades are moveable radially outward to define the shape of the button formed to attach the panels together.

SUMMARY OF THE INVENTION

The invention provides a monitoring device for monitoring the apparatus that clinches together sheet metal panels. In particular, a die assembly positioned on one side of the panels has a button forming die cavity defined by an anvil at the bottom of the die cavity and a plurality of radially moveably die blades at the side of the cavity. A plunger is positioned on the other side of the panels and registers with the die assembly so that linear displacement of the plunger indents and plastically deforms the panels axially into the die assembly until engagement of the bottommost panel with the anvil terminates the axial displacement of the panels. Further linear displacement of the plunger will then deform the panels radially outward as permitted by the outward radial movement of the moveable die blades. A monitoring device includes transducers for measuring the linear displacement of the plunger, the radial outward displacement of the radially moveable die blades, and the magnitude of the axial force applied against the anvil.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain embodiments is merely exemplary in nature and is in no way intended to limit the invention, its application, or uses.

Figure 1:
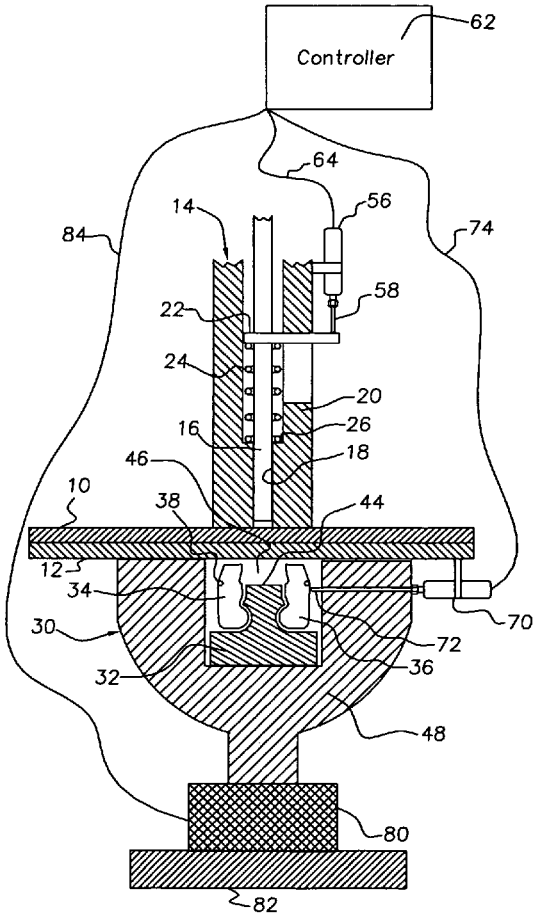
FIG. 1 is a cross-section view taken through the clinching apparatus and shown prior to the operation of the apparatus.

Referring to FIG. 1, sheet metal panels are stacked together and include an upper panel 10 and a lower panel 12. The plunger assembly, generally indicated at 14, is positioned above the top panel 10 and includes a plunger 16 slideably mounted within bore 18 of a housing 20. Plunger 16 is moveable within the bore 18 between a normal at rest position of FIG. 1, and a fully displaced position shown in FIG. 2. The upper end of the plunger 16, not shown, is attached to an operating mechanism, which is preferably a pneumatic or hydraulic cylinder, but could be an electric or other operating mechanism for reciprocating the plunger 16. Plunger 16 carries a shoulder 22. A coil compression spring 24 acts between a shoulder 26 of the housing 20 and the shoulder 22 carried by the plunger 16 to urge the plunger 16 to its rest position of FIG. 1.

FIG. 1 also shows a die assembly, generally indicated at 30, that is located below the lower panel 12, on the opposite side of the panels from the plunger assembly 14. Die assembly 30 includes an anvil housing 32 which pivotally mounts a plurality of die blades, of which a pair of opposed die blades 34 and 36 are shown in FIG. 1. The lower most ends of the die blades 34 and 36 are pivotally journalled on the anvil housing 32 and are held at their normal retracted positions of FIG. 1 by a retainer ring 38 which encircles the die blades 34 and 36. The retainer ring 38 may be either an elastomeric material or an expandable wire ring so as to permit relative outward pivoting movement of the die blades 34 and 36 to their axially expanded positions shown in FIG. 2. The anvil housing 32 also includes an anvil surface 44 which directly underlies the plunger 16. Thus the die assembly 30 has a die cavity 46 which is defined by the anvil surface 44 at its bottom and by the die blades 34 and 36 at its sides. The die assembly 30 also includes a support housing 48 that supports the anvil housing 32.

Figure 2:
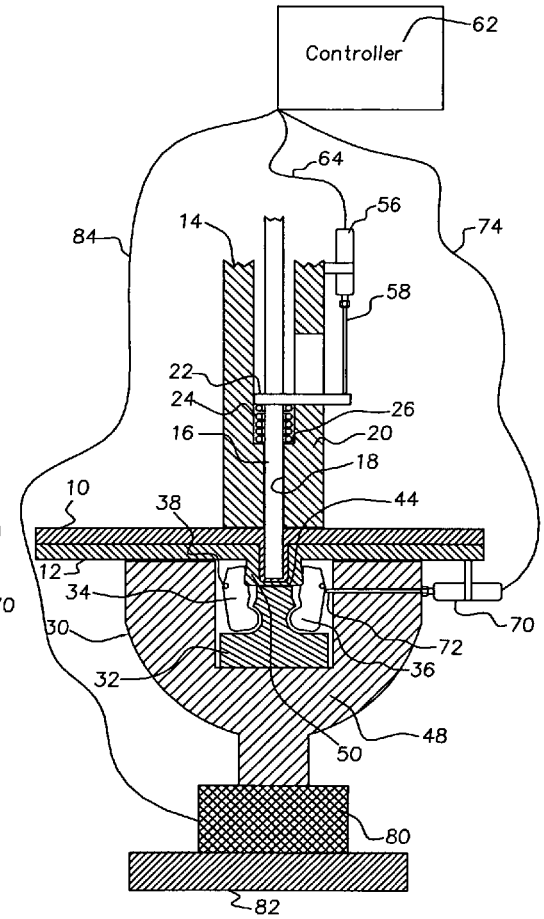
FIG. 2 is a view similar to FIG. 1 but showing the axial movement of the plunger and radial movement of the die cavity die blades during clinching together of the sheet metal panels.

In operation, the plunger 16 is forcibly lowered to its position of FIG. 2 by the plunger operating mechanism. Thus the plunger 16 is thrust against the top panel 10 and plastically deforms the upper panel 10 and the lower panel 12 downwardly into the die cavity 46 of the die assembly 30. When the lower panel 12 is forced against the anvil surface 44, the continuing downward movement of the plunger 16 forces plastic deformation of the panels radially outwardly as seen in FIG. 2, thereby forming a button 50 that mechanically interlocks the panels 10 and 12. This radial outward displacement of the sheet metal of the panels 10 and 12 forces the die side blades 34 and 36 outwardly, as permitted the expansion of the elastic retainer 38. The die blades are shaped to assist in forming the button 50 to accomplish the interlocking of the panels to permanently attach together the panels 10 and 12.

Apparatus for monitoring the clinching process includes a first transducer 56 for measuring the axial displacement of the plunger 16. The transducer 56 is a linear variable differential transformer and includes a spring biased probe 58 that rides on the shoulder 22 carried by the plunger 16. The linear variable differential transducer is a commercially available device, for example SCHAEVITZ GHSD 750. Alternatively the transducer 56 may be a commercially available optical displacement sensor. The transducer 56 is electrically connected to a process controller 62 by a cable 64.

A transducer 70 is provided for measuring the radial displacement of the die blade 36. The transducer 70 is preferably a linear variable displacement transformer like the transducer 56 and includes a spring loaded probe 72 that engages with the die blade 36. Alternatively the transducer 70 may be an optical displacement sensor. The transducer 70 is electrically connected to the process controller 62 by cable 74.

A third transducer 80 is a load cell and is interposed between the lower end of the die assembly support housing 48 and a support plate 82. It will be understood that the load cell 80 supports the die assembly support housing 48 and the anvil housing 32 and accordingly will be subjected to the axial load that the plunger 16 applies against the anvil surface 44 during the formation of the button 50 interlocking the sheet metal panels. The load cell 80 is connected to the process controller 62 by a cable 84.

Figure 3:
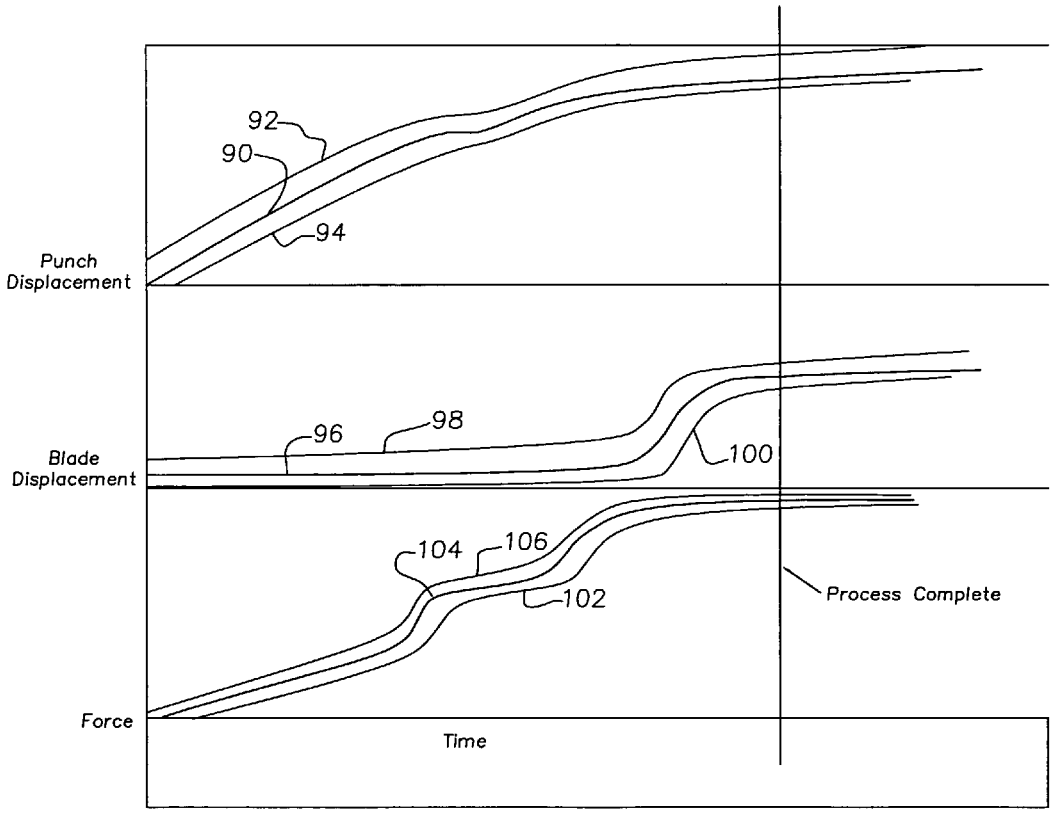
FIG. 3 is a graph which plots the plunger displacement, die blade displacement, and axial load, versus time.

Referring to FIG. 3, a graph is shown to display the displacement and force characteristics of the clinching process. In particular curve 90 is a plot of punch displacement versus time. Curves 92 and 94 are plotted respectively above and below the curve 90 and represent an upper control limit and a lower control limit. Curve 96 is a plot of blade displacement versus time and has an upper control limit 98 and a lower control limit 100. Curve 104 is a plot of anvil force versus time and has upper control limit 106 and lower control limit 102. It will be understood and appreciated that the process controller 62 will monitor the punch displacement, blade displacement, and anvil force during the conduct of the clinching process and may perform any of a number of monitoring and control functions. For example the process controller may simply provide reports and warning signals. Or the process controller may initiate automatic adjustment of the plunger stroke and force in the event that the process is operating outside the normal control limits for any of the monitored conditions. In addition, the punch 16 and its displacement sensor may be used to measure the thickness of the stack of sheet metal plates and to initiate automatic adjustment of the plunger stroke or force to accommodate variations in the stack thickness.

It will be understood that the foregoing description of the invention is merely exemplary in nature and, thus, variations thereof are intended to be within the scope of the invention. For example, the drawings show sensors for sensing punch displacement, blade displacement, and axial force. However, it may be useful and desirable to monitor any one of these conditions or two of these conditions, as opposed to measuring all three as shown in the drawings. For example, the transducer 70 measures the displacement of blade 36 and that displacement is directly related to the formation of the button 50. Thus it may be useful to collect data from die blade transducer 70 even if the other transducers are not employed. In addition, other known displacement transducers and forced measuring transducers may be substituted for the particular transducers shown in the drawings. Although the drawings show two panels that are clinched together, the invention is also useful when clinching together a stack of three or more panels.

The invention claimed is:

1. Apparatus for clinching together first and second stacked sheet metal panels, comprising:

a die assembly positioned on one side of the panels and having a button forming cavity defined by an anvil at the bottom of the cavity and a plurality of radially movable die blades at the sides of the cavity, a plunger positioned on the other side of the panels and registered with the die assembly so that linear displacement of the plunger plastically deforms the panels axially into the die assembly until engagement with the anvil terminates axial displacement of the panels and further linear displacement of the plunger deforms the panels radially outward as permitted by the outward radial movement of the movable die blades;

a monitoring device including a transducer for measuring at least one of the linear displacement of the plunger, the radial outward displacement of one of the radially movable die blades, and a force applied against the anvil.

2. The apparatus of claim 1 in which the monitoring device includes a pair of transducers for measuring any two of the linear displacement of the plunger, the radial outward displacement of one of the radially movable die blades, and the force applied against the anvil.

3. The apparatus of claim 1 in which the monitoring device includes a first transducer for measuring the linear displacement of the plunger, a second transducer for measuring the radial outward displacement of at least one of the radially movable die blades, and a third transducer for measuring the force applied against the anvil.

4. The apparatus of claim 3 in which the transducers are connected to a data recording controller device that monitors the measured displacements and force to enable monitoring and control of the clinching apparatus.

5. The apparatus of claim 1 in which the transducer for measuring the linear displacement of the plunger is a linear variable differential transformer.

6. The apparatus of claim 1 in which the transducer for measuring the linear displacement of the plunger is an optical displacement sensor.

7. The apparatus of the claim 1 in which the transducer for measuring the force applied against the anvil is a load cell.

8. The apparatus of claim 1 in which the monitoring device is a transducer measuring the linear displacement of the plunger, and more particularly the plunger is mounted within a housing and a linear variable displacement transformer is mounted on the housing and has a spring loaded probe that engages with a shoulder carried by the plunger so that the spring loaded probe follows the linear displacement of the plunger.

9. The apparatus of claim 1 in which the monitoring device is a transducer measuring the linear displacement of the plunger, and more particularly the plunger is mounted within housing and an optical displacement sensor is mounted on the housing and observes a shoulder carried by the plunger so as to follow the linear displacement of the plunger.

10. The apparatus of claim 1 in which the monitoring device is a transducer measuring the force applied against the anvil, and more particularly the anvil of the die assembly is carried by housing and a load cell transducer supports the anvil and measures the force exerted on the load cell by the anvil.

11. The apparatus of claim 1 in which the monitoring device is a transducer measuring the radial outward displacement of one of the radially movable die blades, and more particularly a housing surrounds the movable die blades and a linear variable differential transformer is mounted on the housing and has a spring loaded probe that engages the movable die blade to measure the displacement of the die blade.

12. The apparatus of claim 1 in which the transducer is connected to a data recording controller device that monitors the measured displacements and force to enable monitoring and control of the clinching apparatus.

13. The apparatus of claim 12 in which the transducers are connected to a data recording controller device that monitors the measured displacements and force to enable monitoring and control of the clinching apparatus.

14. Apparatus for clinching together first and second stacked sheet metal panels, comprising:

a die assembly positioned on one side of the panels and having a button forming cavity defined by an anvil at the bottom of the cavity and a plurality of radially movable die blades at the sides of the cavity, a plunger positioned on the other side of the panels and registered with the die assembly so that linear displacement of the plunger plastically deforms the panels axially into the die assembly radially outward as permitted by the radial movement of the movable die blades to form an interlocking button that clinches the panels together;

and a monitoring system including a transducer for measuring the linear displacement of the plunger, a transducer for measuring the radial displacement of at least one of the radially movable die blades, and a transducer for measuring the force applied against the anvil by the displacement of the plunger.

15. Apparatus for clinching together first and second stacked sheet metal panels, comprising:

a die assembly positioned on one side of the panels and having a button forming cavity defined by an anvil at the bottom of the cavity and a plurality of radially movable die blades at the side of the cavity, a plunger positioned on the other side of the panels and registered with the die assembly so that linear displacement of the plunger plastically deforms the panels axially into the die assembly until engagement with the anvil terminates axial displacement of the panels and further linear displacement of the plunger deforms the panels radially outward as permitted by the radial movement of the movable die blades;

a transducer for measuring the linear displacement of the plunger, a transducer for measuring the radial outward displacement of at least one of the radially movable die blades, and a transducer for measuring a force applied against the anvil by the displacement of the plunger;

and a data recording controller device that monitors the measured displacements and force to enable monitoring and control of the clinching apparatus.

16. The apparatus of claim 15 in which the displacement transducer is a linear voltage differential transformer.

17. The apparatus of claim 15 in which the displacement transducer is an optical sensor.

18. The apparatus of claim 15 in which the force transducer is a load cell.

* * * * *